United States Patent [19]

Mollet

[11] Patent Number: 4,785,738

[45] Date of Patent: Nov. 22, 1988

[54] DETACHABLE GONDOLA LIFT OR CHAIR-LIFT

[75] Inventor: Alain Mollet, Seyssins, France

[73] Assignee: Pomagalski S.A., France

[21] Appl. No.: 42,781

[22] Filed: Apr. 27, 1987

[30] Foreign Application Priority Data

May 6, 1986 [FR] France ..... 86 06687

[51] Int. Cl.[4] ..... B61B 11/00

[52] U.S. Cl. ..... 104/173.2; 104/91; 104/172.4

[58] Field of Search ..... 104/88, 91, 172.1, 172.3, 104/172.4, 173.1, 173.2

[56] References Cited

U.S. PATENT DOCUMENTS

| | | | |
|---|---|---|---|
| 1,556,819 | 10/1925 | Hires | 104/173.1 |
| 2,745,542 | 5/1956 | Boots | 104/173.1 |
| 4,030,423 | 6/1977 | Krammer | 104/172.4 |
| 4,050,385 | 9/1977 | Gurr et al. | 104/173.2 |
| 4,563,955 | 1/1986 | Tarassoff | 104/173.2 |
| 4,627,361 | 12/1986 | Tarassoff | 104/173.2 |
| 4,641,584 | 2/1987 | Bertrand | 104/173.2 |
| 4,699,064 | 10/1987 | Tarassoff | 104/173.2 |

FOREIGN PATENT DOCUMENTS

| | | |
|---|---|---|
| 0114129 | 7/1984 | European Pat. Off. . |
| 0170587 | 2/1986 | European Pat. Off. . |

*Primary Examiner*—George L. Walton

*Attorney, Agent, or Firm*—Parkhurst, Oliff & Berridge

[57] ABSTRACT

A parking track of a gondola lift or chair-lift comprises straight sections and curved sections and chains for driving cars on this track. On the straight sections the cars follow one another closely or almost touching and on the curved sections with a greater clearance sufficient to pass without the risk of one another colliding.

6 Claims, 4 Drawing Sheets

DETACHABLE GONDOLA LIFT OR CHAIR-LIFT

BACKGROUND OF THE INVENTION

The invention relates to an aerial ropeway transport installation, notably a gondola lift or chair-lift having vehicles, notably cars or chairs suspended from grips coupling them to the rope, having roller sheaves, said grips being able to be detached from the aerial rope in the terminals and to run on a transfer and/or parking track before being recoupled to the rope, said track comprising stright sections and curved sections and a means of driving the vehicles.

In an installation of the kind mentioned, the vehicles run at high speed on the line, being driven by the aerial rope and at low speed in the terminal after they have been detached from the rope. The vehicles detached from the rope run on the transfer track of the terminal, bumping into one another frequently, and it has already been proposed to equip the transfer track with a drive chain maintaining a certain distance between the vehicles. This gap is sufficient to avoid any contact or collision between the vehicles which follow one another, even on the curved sections of the track, but it reduces the number of vehicles present on the track at any one time. The clearance between the vehicles in the loading and unloading areas may be a drawback. The same problem arises for the parking tracks equipped with drive means where the gap between the vehicles on the straight sections reduces the storage capacity.

SUMMARY OF THE INVENTION

The object of the present invention is to achieve a means of driving the vehicles in the terminal without the risk of bumping while maintaining a minimum distance between the vehicles.

The installation according to the invention is characterized by the fact that said driving means is arranged to drive the vehicles on the straight sections following one another closely or almost touching and on the curved sections with a greater clearance sufficient for the curved sections to be passed through without the risk of the vehicles following one another colliding.

The clearance distance of the vehicles is determined on the one hand by the radius of curvature of the tightest curve of the track and on the other hand by the dimensions, notably the width of the vehicles. To vary this clearance distance, the drive speed simply has to be modified, accelerating the vehicles in the curves, while keeping the low speed on the straight sections corresponding to the optimum speed for loading and unloading of the passengers.

Acceleration in the curves is advantageously achieved by a separate driving means, notably a chain with a higher synchronized speed to keep the regular spacing. The chain may be replaced by a wheel having drive pins on its circumference or by a pneumatic tyred wheel train of the kind used on the acceleration and deceleration sections. The same chain can be used for driving on the straight and curved sections, if care is taken to have the vehicles follow a longer trajectory in the curves than that of the chain to achieve the required acceleration. The driving means are naturally adapted to the type of installation involved, these means being simplified when they equip a storage track and more elaborate for a transfer track on which the vehicles pass continuously.

The invention is applicable to any single-rope or multi-rope installation with detachable vehicles, notably to gondola lifts, in which impacts between the vehicles should be avoided for equipment wear and passenger comfort reasons.

BRIEF DESCRIPTION OF THE DRAWINGS

Other advantages and characteristics will become more clearly apparent from the following description of an embodiment of the invention, given as a non-limiting example only, and represented in the accompanying drawings, in which.

DESCRIPTION OF THE PREFERRED EMBODIMENT

Figure 1:
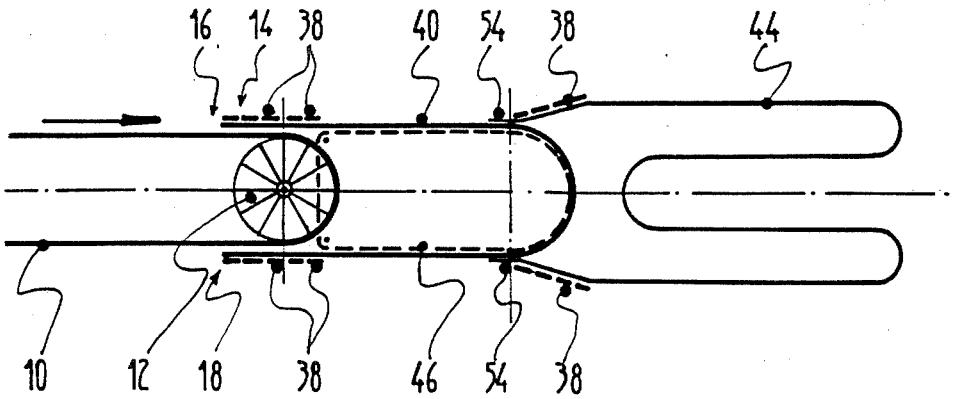
FIG. 1 is a schematic plan view of a gondola lift terminal according to the invention.

In the figures, a terminal of a gondola lift with a carrier-hauling rope 10 comprises a vertical-axis bull-wheel 12 on which the rope 10 passes. Coupled to the rope 10 on the line are cars 14, which are detached from the rope 10 at the entry 16 to the terminal. At the exit 18 from the terminal, the cars 14 are recoupled to the opposite track of the rope in a manner well-known in the art. Each car 14 comprises a hanger arm 20 fixed to a carriage 22 supporting one or two grips 24, biased to the closed position by springs 26. An operating lever 28 cooperates with a control rail 30 to control opening and closing of the grip and attachment and detachment of the grip 24 to the rope 10. The carriage 22 with sheaves 32, 34 runs in the terminal, after it has been detached from the rope 10, on a transfer rail 40 linking the two tracks of the rope 10 being driven either by tyred wheels 38, acting on a friction face 36 of the carriage 22, or by a chain 46 having drive pins 48 which operate in conjunction with the hanger arm 20. The chain guide 50 is secured by a support 52 to the rail 40. Parking rails 44 are connected to the transfer rails 40 by means of switching points 54 enabling the cars 14 to be taken off to the storage area at the end of the day and to be put back into circulation when the installation is started up. The parking rails 44 are arranged in a loop to achieve a maximum car storage capacity, the trajectory naturally depending on the surfaces available. The tyred wheels 38 are arranged at the entry 16 to the terminal to decelerate the cars detached from the rope, at the exit 18 to accelerate the cars before they are recoupled to the rope, and in the switching points areas 54. The transfer chain 46 extends along the rail 40 to drive the cars 14 at reduced speed for loading and unloading of the passengers. Gondola lifts of this kind are well-known in the art.

Figure 2:
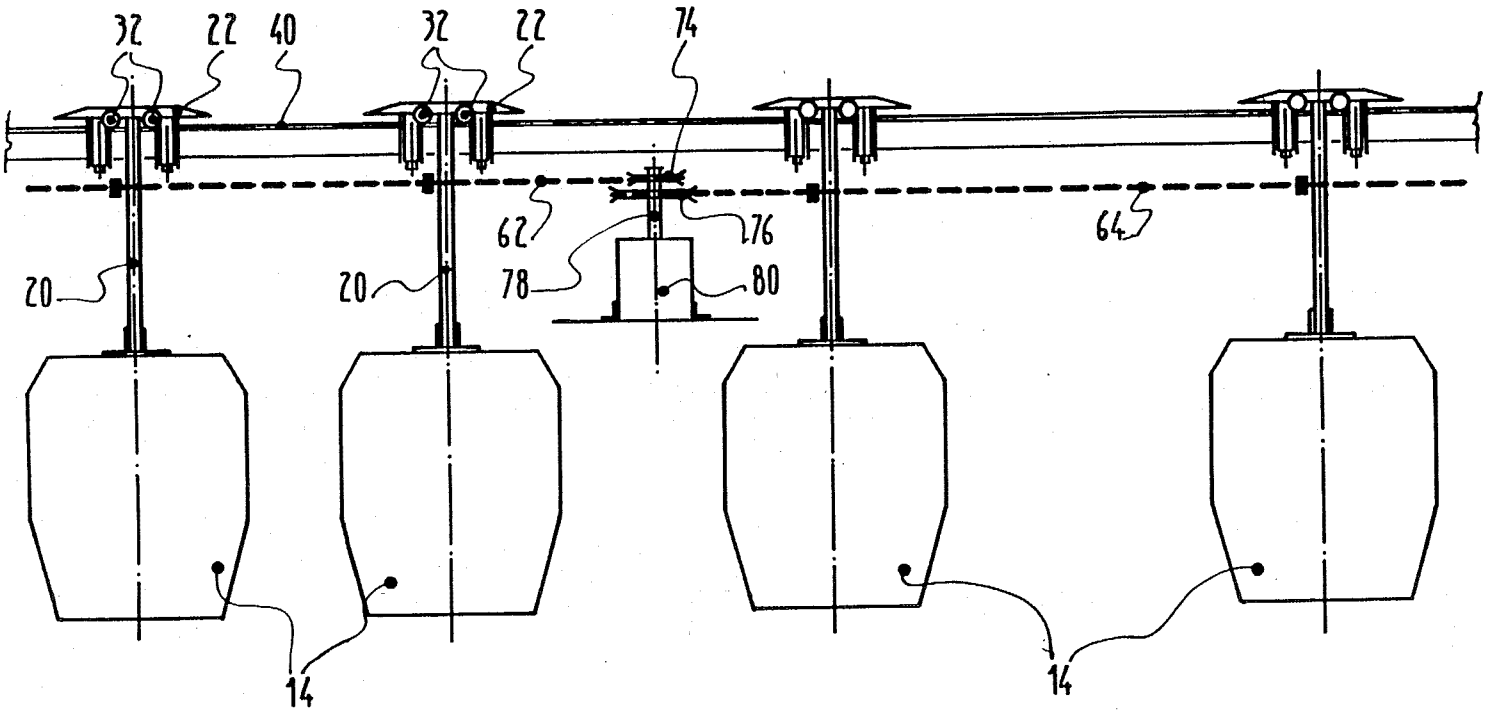
FIG. 2 is an elevation view, on an enlarged scale, of a section of the parking track of the gondola lift according to FIG. 1.
Figure 3:
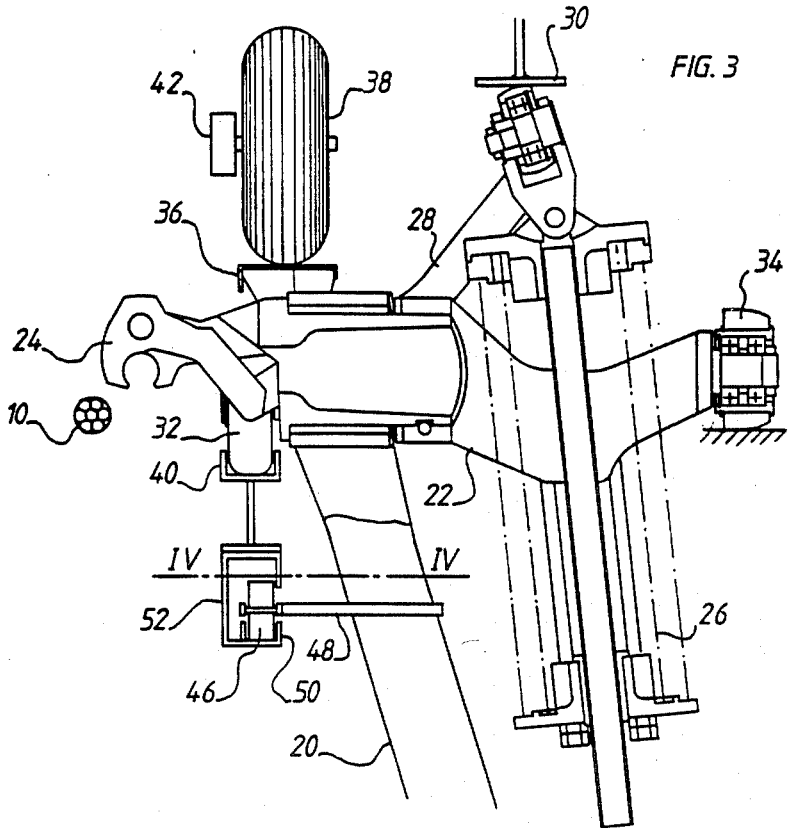
FIG. 3 is a side view, on an enlarged scale, of the car support grip according to FIG. 2.
Figure 4:
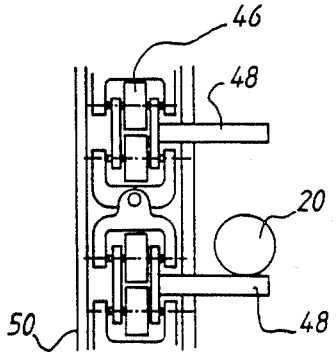
FIG. 4 is a cross-section along line IV—IV of FIG. 3.
Figure 5:
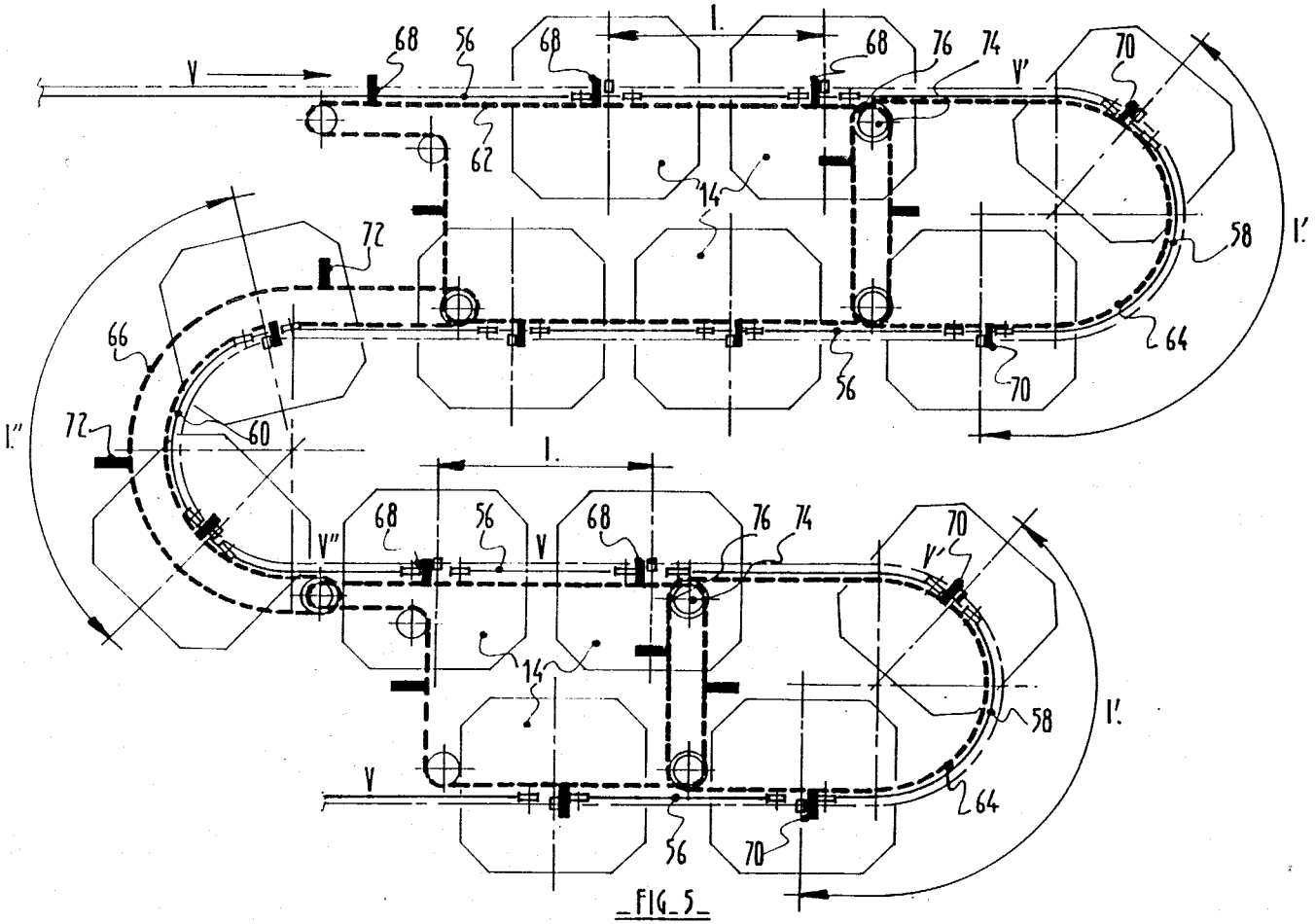
FIG. 5 is a plan view of the parking track.

Referring more particularly to FIG. 5, it can be seen that the parking rails 44 comprise parallel straight sections 56 connected at the ends by curved sections 58, 60. The distance between the parallel straight sections 56 is slightly greater than the width of the cars 14 to store the latter in rows with minimum clearance and the radius of the curves 58, 60 is naturally determined by this clearance. The cars 14 are driven positively along the parking rails 44 by chains 62, 64, 66 extending respectively according to the straight sections 56, the outside curved sections 58 and the inside curved sections 60. The chain or chains 62 of the straight sections 56 have drive pins 68 whose distance apart I is slightly greater than the length of the cars 14, in such a way that two successive cars 14 are almost in contact but without the risk of bumping into one another. This prevents impacts between the cars 14 while at the same time occupying a minimum storage space. It can easily be seen that this distance apart is too small when passing through a curved section 58, 60, the inside corners of the cars 14 coming into contact. According to the invention, the car reaching a curved section 58, 60 is taken up by another chain 64, 66 having drive pins 70, 72 a greater distance apart I', I'', guaranteeing that the curve is passed without the cars colliding. In order to maintain a continuous flow of cars 14, the speed of the chains 64, 66 must be greater than that of the chain 62, in the ratio of the distances apart. In the example illustrated in FIGS. 2 and 5, the successive chains 62, 64 ; 64, 66 pass over cogwheels 74, 76 securedly fixed on a single spindle 78 driven by a motor 80, the diameter of the wheel 74 of the chain 62 being smaller than the diameter of the wheel 76 driving the faster chain 64. The synchronism is thus perfectly preserved and the cars 14 move more quickly on the curved sections 58, 60 than on the straight sections 56. The same chain 62 can extend along two straight sections 56 or all the straight sections of the parking tracks, driving being able to be achieved in any way, for instance derived from the rope 10. The return strands of the chains may follow any trajectory, either parallel to the active strand, or shortened. Similarly, all the curved sections 58, 60 may be equipped with a single chain, the solution with several chains being however preferable when the sections are distant from one another. These chains may have pins 70, 72 with different spacings according to the radius of curvature of the curve or according to whether the curve is of the inside or outside type, the speed being in this case also different. It is clear that driving can be achieved in a different manner over some or all of the sections, notably by means of tyred wheels, and that the trajectories may have any form.

Figure 6:
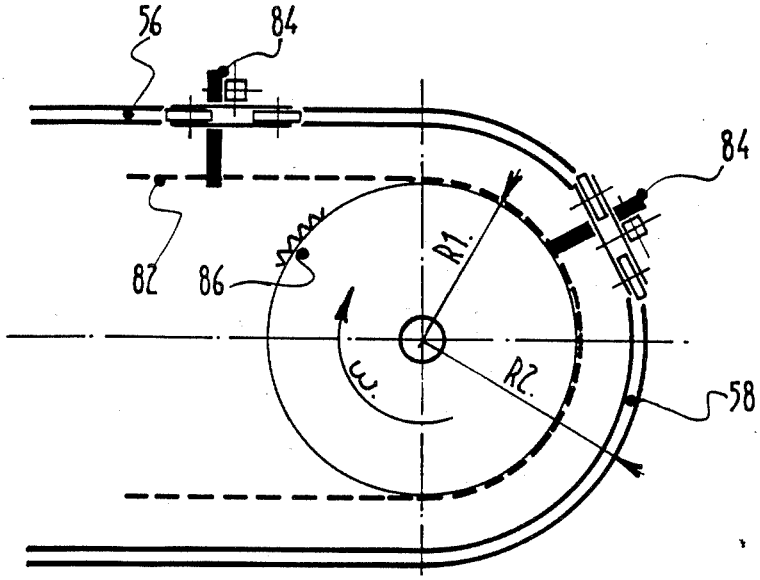
FIG. 6 is a plan view illustrating an alternative embodiment of the car driving means.

FIG. 6 illustrates an alternative embodiment for driving at differential speed by a single chain 82 with relatively long pins 84. The chain 82 follows the trajectory of the parking rail 44 on the inside at a certain distance passing over a cogwheel 86 concentric with the curved section 58. It can easily be seen that an angular speed of the wheel 86 imposes a linear speed $R_1$, $R_1$ being the radius of the wheel 86, on the cars over the straight section 56 and a circumferential speed $R_2$ over the curved section 58, $R_2$ being the radius of curvature of the curve 58. The acceleration effect is thus achieved automatically. Other embodiments are conceivable, the cogwheel 86 being able to be replaced by other guiding means.

Operation of the gondola lift is apparent from the above description.

The invention has been described as being applied to parking tracks, but it has the same advantages of bringing the cars as close together as possible on a transfer track 40, thus avoiding spaces between the cars lined up alongside the loading and unloading platforms. If the transfer track is used as a storage track, its capacity is consequently increased. The gain is all the greater the wider the vehicles, which may be cars, trucks or chairs, and the invention can be applied to any installation, single-rope, double-rope detachable with continuous running or not. If the radius of curvature of certain curves is sufficiently great to avoid collisions, these curves do not require accelerated driving of the cars.

I claim:

1. An aerial ropeway transport installation, in particular a gondola lift or chair-lift, having terminal stations equipped with transfer and/or parking tracks, grips for coupling to a rope, having roller sheaves, said grips being able to be detached from the aerial ropeway in the terminals and to run on the transfer and/or parking track before being recoupled to the rope, said track comprising straight sections and curved sections, vehicles, in particular cars or chairs, suspended from the grips and a means for driving the vehicles arranged so as to drive the vehicles following one another closely or almost touching on the straight sections at a first speed, and on the curved sections at a greater speed than said first speed so as to increase the distance between vehicles with a clearance sufficient for the curved sections to be passed through without the risk of the vehicles following one another colliding.

2. The installation according to claim 1, having an outgoing aerial ropeway track and a return track joined by said transfer track on which transfer track the vehicles run at low speed for loading and unloading of the passengers being almost end to end on the straight sections and spaced slightly apart on the curved sections.

3. The installation according to claim 1, comprising a means of driving the vehicles over the curved sections and a means of driving the vehicles over the straight sections, the driving speed over the curved sections being greater than the driving speed over the straight sections.

4. The installation according to claim 1, comprising a first chain with pins to drive the vehicles over a straight section and a second chain with drive pins over the curved sections, said chains being driven at differential speeds and the distance between the pins of the first chain being smaller than the distance between the pins of the second chain, these gaps corresponding to the minimum distance between vehicles without the risk of them bumping into one another.

5. The installation according to claim 4, having a curved section joining two parallel straight sections, the first drive chain extending in a closed loop along the two straight sections passing on countergear cogwheels at the end of these sections and the second drive chain being endless and extending along the curved section passing over countergear cogwheels secured to the same spindle as the straight section cogwheels to be driven at the same speed of rotation, the diameter of the curved section cogwheels being greater than that of the straight section cogwheels.

6. The installation according to claim 1, comprising a drive chain common to the straight sections and the curved sections, the trajectory followed by the vehicles on the curved sections being longer than the trajectory of said chain along these curved sections to accelerate the movement of the vehicles through the curves.

* * * * *